US008460592B2

(12) United States Patent
Breier et al.

(10) Patent No.: US 8,460,592 B2
(45) Date of Patent: Jun. 11, 2013

(54) PROCESS OF FORMING A HOLLOW WOOD-TYPE GOLF CLUB HEAD

(75) Inventors: Joshua G. Breier, Vista, CA (US); Gregory Haralson, Laguna Niguel, CA (US); Scott A. Rice, San Diego, CA (US); Allan Saliba, Oceanside, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 11 days.

(21) Appl. No.: 13/103,920

(22) Filed: May 9, 2011

(65) Prior Publication Data

US 2011/0272846 A1 Nov. 10, 2011

Related U.S. Application Data

(60) Division of application No. 11/600,081, filed on Nov. 16, 2006, now Pat. No. 7,938,740, which is a continuation-in-part of application No. 11/363,098, filed on Feb. 28, 2006, now Pat. No. 7,524,249, which is a continuation-in-part of application No. 11/110,733, filed on Apr. 21, 2005, now Pat. No. 7,658,686, and a continuation-in-part of application No. 11/180,406, filed on Jul. 13, 2005, now Pat. No. 7,377,860.

(51) Int. Cl.
*B29C 43/18* (2006.01)
*B29C 45/14* (2006.01)

(52) U.S. Cl.
USPC ..... 264/248; 264/275; 264/269; 264/267; 264/257; 264/258

(58) Field of Classification Search
None
See application file for complete search history.

(56) References Cited

U.S. PATENT DOCUMENTS 1,349,806 A 8/1920 Booth
1,361,258 A 12/1920 Horton (Continued)

FOREIGN PATENT DOCUMENTS

JP 02180281 * 7/1990
JP 02180282 * 7/1990

(Continued)

OTHER PUBLICATIONS

European Search Report for European application No. 10013627.4-2318, dated Mar. 11, 2011, in 8 pages.

(Continued)

*Primary Examiner* — Edmund H. Lee
(74) *Attorney, Agent, or Firm* — Mark S. Leonardo; Brown Rudnick LLP

(57) ABSTRACT

A hollow golf club head with a concave portion is disclosed and claimed. The club head includes a metallic portion and a light-weight portion, which may be formed of plastic, composite, or the like. The concave portion allows the club designer to make a club head having very thin portions while still maintaining the requisite structural integrity. Convex bulges may optionally be provided to house weight inserts to enhance the playing characteristics of the golf club. The metallic portion of the club head may take on the appearance of a frame, into which several light-weight inserts are positioned. These light-weight inserts may be positioned in the crown, skirt, and sole of the club head. The club head may be formed by co-molding, eliminating the need for welding or adhesives, freeing mass to be used in more beneficial ways. The club head may be large to increase playability and forgiveness.

19 Claims, 15 Drawing Sheets

U.S. PATENT DOCUMENTS 1,412,650 A 4/1922 Booth
1,452,845 A 4/1923 Pryde
1,455,379 A 5/1923 Allen
1,552,297 A 9/1925 Harness
1,559,299 A 10/1925 Barach
1,574,213 A 2/1926 Tyler
1,575,364 A 3/1926 Hodgkins
1,705,997 A 3/1929 Williams
2,774,600 A * 12/1956 Reach ..... 473/328
3,143,349 A * 8/1964 MacIntyre ..... 473/338
3,166,320 A 1/1965 Onions
3,356,782 A * 12/1967 Whyte ..... 264/267
3,556,533 A 1/1971 Hollis
3,843,122 A * 10/1974 Florian ..... 473/329
3,941,390 A * 3/1976 Hussey ..... 473/292
3,966,210 A 6/1976 Rozmus
D240,644 S 7/1976 Manfrin
3,985,363 A 10/1976 Jepson et al.
4,021,047 A 5/1977 Mader
4,043,563 A 8/1977 Churchward
4,085,934 A 4/1978 Churchward
4,193,601 A 3/1980 Reid, Jr. et al.
D262,049 S 11/1981 Simmons
4,432,549 A 2/1984 Zebelean
4,438,931 A 3/1984 Motomiya
4,650,626 A * 3/1987 Kurokawa ..... 264/278
4,653,756 A 3/1987 Sato
4,762,322 A 8/1988 Molitor et al.
4,792,140 A 12/1988 Yamaguchi et al.
4,869,507 A 9/1989 Sahm
4,872,683 A 10/1989 Doran et al.
4,872,685 A 10/1989 Sun
4,883,275 A 11/1989 Broone
4,912,830 A * 4/1990 Vesligaj ..... 29/458
5,186,465 A 2/1993 Chorne
5,198,062 A * 3/1993 Chen ..... 156/245
5,205,560 A 4/1993 Hoshi et al.
5,213,328 A 5/1993 Long et al.
5,213,329 A * 5/1993 Okumoto et al. ..... 473/328
5,255,913 A 10/1993 Tsuchida
5,272,802 A * 12/1993 Stites, III ..... 29/527.2
5,310,186 A 5/1994 Karsten
5,346,217 A 9/1994 Tsuchiya et al.
5,435,558 A 7/1995 Iriarte
5,447,309 A 9/1995 Vincent
5,474,297 A 12/1995 Levin
5,484,155 A 1/1996 Yamawaki et al.
5,547,188 A 8/1996 Dumontier et al.
5,624,331 A 4/1997 Lo et al.
5,665,014 A 9/1997 Sanford et al.
5,769,736 A 6/1998 Sato
5,785,609 A 7/1998 Sheets et al.
5,797,176 A 8/1998 Rose et al.
5,842,935 A 12/1998 Nelson
5,935,020 A 8/1999 Stites et al.
5,947,840 A 9/1999 Ryan
5,951,412 A * 9/1999 Rose et al. ..... 473/340
5,997,415 A 12/1999 Wood
D418,885 S 1/2000 Wanchena
6,012,989 A 1/2000 Saksun
6,059,669 A 5/2000 Pearce
6,074,308 A 6/2000 Domas
6,077,171 A 6/2000 Yoneyama
6,089,994 A 7/2000 Sun
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,248,025 B1 * 6/2001 Murphy et al. ..... 473/324
6,248,026 B1 6/2001 Wanchena
6,254,494 B1 7/2001 Hasebe et al.
6,306,048 B1 * 10/2001 McCabe et al. ..... 473/333
6,332,848 B1 12/2001 Long et al.
6,340,337 B2 1/2002 Hasebe et al.
6,354,962 B1 3/2002 Galloway et al.
6,375,583 B1 * 4/2002 Solheim ..... 473/329
6,409,612 B1 6/2002 Evans et al.
6,416,422 B1 * 7/2002 Nagai et al. ..... 473/328
6,422,951 B1 7/2002 Burrows
6,440,009 B1 8/2002 Guibaud et al.
6,471,604 B2 10/2002 Hocknell et al.
6,482,106 B2 11/2002 Saso
6,565,452 B2 5/2003 Helmstetter et al.
6,572,491 B2 6/2003 Hasebe et al.
6,575,845 B2 6/2003 Galloway et al.
6,592,468 B2 7/2003 Vincent et al.
6,623,378 B2 9/2003 Beach et al.
6,645,086 B1 11/2003 Chen
6,648,773 B1 11/2003 Evans
6,716,114 B2 4/2004 Nishio
6,739,983 B2 5/2004 Helmstetter et al.
6,739,984 B1 5/2004 Ciasullo
6,773,360 B2 8/2004 Willett et al.
6,776,723 B2 8/2004 Bliss et al.
6,860,818 B2 3/2005 Mahaffey et al.
6,872,152 B2 3/2005 Beach et al.
6,890,267 B2 5/2005 Mahaffey et al.
6,896,625 B2 5/2005 Grace
6,902,496 B2 * 6/2005 Solheim et al. ..... 473/341
6,902,497 B2 6/2005 Deshmukh et al.
6,913,546 B2 7/2005 Kakiuchi
6,921,343 B2 * 7/2005 Solheim ..... 473/329
6,926,615 B1 8/2005 Souza et al.
6,929,565 B2 8/2005 Nakahara et al.
6,932,875 B2 8/2005 Cheng et al.
6,955,612 B2 10/2005 Lu
6,988,956 B2 1/2006 Cover et al.
6,991,555 B2 1/2006 Reese
6,991,558 B2 1/2006 Beach et al.
6,991,560 B2 * 1/2006 Tseng ..... 473/332
7,008,332 B2 3/2006 Liou
7,022,030 B2 4/2006 Best et al.
7,025,692 B2 4/2006 Erickson et al.
7,070,517 B2 7/2006 Cackett et al.
7,128,664 B2 10/2006 Onoda et al.
7,140,974 B2 11/2006 Chao et al.
7,147,573 B2 12/2006 DiMarco
7,160,040 B2 1/2007 Matsushima
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,175,541 B2 2/2007 Lo
7,186,190 B1 3/2007 Beach et al.
7,204,768 B2 4/2007 Nakahara et al.
7,252,599 B2 8/2007 Haseguwa
7,258,625 B2 8/2007 Kawaguchi et al.
7,281,993 B2 10/2007 Oyama
7,303,487 B2 * 12/2007 Kumamoto ..... 473/345
7,338,390 B2 3/2008 Lindsay
D567,888 S 4/2008 Soracco
7,371,191 B2 5/2008 Sugimoto
7,377,860 B2 5/2008 Breier et al.
7,491,131 B2 2/2009 Vinton
7,524,249 B2 4/2009 Breier et al.
7,530,901 B2 5/2009 Imamoto et al.
7,549,933 B2 6/2009 Kumamoto
7,632,195 B2 12/2009 Jorgensen
7,658,686 B2 2/2010 Soracco
7,753,809 B2 7/2010 Cackett et al.
7,803,065 B2 9/2010 Breier et al.
7,806,782 B2 10/2010 Stites et al.
7,938,740 B2 5/2011 Breier et al.
7,980,964 B2 7/2011 Soracco
8,353,783 B2 * 1/2013 Soracco ..... 473/332
2001/0001302 A1 5/2001 Murphy et al.
2001/0049310 A1 12/2001 Cheng et al.
2002/0045490 A1 4/2002 Ezawa et al.
2002/0077195 A1 6/2002 Carr et al.
2002/0137576 A1 9/2002 Dammen
2002/0160858 A1 10/2002 Lee
2002/0169033 A1 * 11/2002 Sery ..... 473/324
2003/0045371 A1 3/2003 Wood et al.
2003/0100381 A1 5/2003 Murphy et al.
2003/0134690 A1 7/2003 Chen 2003/0144078 A1 7/2003 Setokawa et al.
2003/0162608 A1 8/2003 Chen
2004/0043830 A1 * 3/2004 Imamoto ..... 473/332
2004/0138002 A1 7/2004 Murray
2004/0176177 A1 9/2004 Mahaffey et al.
2004/0192468 A1 9/2004 Onoda et al.
2004/0242343 A1 12/2004 Chao et al.
2004/0254030 A1 12/2004 Nishitani et al.
2005/0119070 A1 6/2005 Kumamoto
2005/0159243 A1 7/2005 Chuang
2005/0170907 A1 8/2005 Saso
2005/0215354 A1 9/2005 Kumamoto
2005/0272527 A1 12/2005 Sugimoto
2006/0014592 A1 1/2006 Sugimoto
2006/0052177 A1 3/2006 Nakahara et al.
2006/0052181 A1 3/2006 Serrano et al.
2006/0100032 A1 5/2006 Imamoto et al.
2006/0116218 A1 6/2006 Burnett et al.
2007/0054751 A1 3/2007 Breier et al.
2007/0265109 A1 11/2007 Elmer
2008/0070721 A1 3/2008 Chen et al.
2008/0227564 A1 9/2008 Breier et al.
2008/0242445 A1 10/2008 Mergy et al.
2008/0261715 A1 10/2008 Carter
2008/0268980 A1 10/2008 Breier et al.
2009/0118034 A1 5/2009 Yokota
2009/0186717 A1 7/2009 Stites
2009/0203465 A1 8/2009 Stites
2010/0041490 A1 2/2010 Boyd et al.
2010/0105499 A1 4/2010 Roach et al.
2010/0130305 A1 5/2010 Soracco
2011/0053706 A1 3/2011 Breier et al.

FOREIGN PATENT DOCUMENTS

JP 6-285190 * 10/1994
JP 08-089603 4/1996
JP 09-192269 7/1997
JP 2000-024149 1/2000
JP 2002-336389 11/2002
JP 2003-093554 4/2003
JP 2003-310808 11/2003
JP 2004-121744 4/2004
JP 2004-159680 6/2004
JP 2004-337327 12/2004
JP 2006-025929 2/2006
JP 2006-130065 5/2006
WO WO 2004-052472 6/2004
WO WO 2007/101350 9/2007

OTHER PUBLICATIONS

Jackson, Jeff, The Modern Guide to Golf Clubmaking. Ohio: Dynacraft Golf Products, Inc. copyright 1994, p. 239.
Japanese Office Action for Application No. 2007-311561, dated Jun. 30, 2010, in 7 pages.
Japanese Office Action titled Pretrial Reexamination Report for Japanese Application No. 2007-085624, (Appeal Trial No. 2010-009497), dated Jul. 7, 2010, in 6 pages.

* cited by examiner

PROCESS OF FORMING A HOLLOW WOOD-TYPE GOLF CLUB HEAD

CROSS-REFERENCE TO RELATED APPLICATIONS

This application is a divisional of U.S. patent application Ser. No. 11/600,081, filed Nov. 16, 2006, now U.S. Pat. No. 7,938,740, which a is a continuation-in-part of U.S. patent application Ser. No. 11/363,098 filed on Feb. 28, 2006, now U.S. Pat. No. 7,524,249, which is 1) a continuation-in-part of U.S. patent application Ser. No. 11/110,733 filed on Apr. 21, 2005, now U.S. Pat. No. 7,658,686, and 2) a continuation-in-part of U.S. patent application Ser. No. 11/180,406 filed on Jul. 13, 2005, now U.S. Pat. No. 7,377,860. Each of these documents is incorporated herein by reference in its entirety.

BACKGROUND OF THE INVENTION

1. Field of the Invention

The present invention relates to a golf club, and, more particularly, the present invention relates to a large wood-type golf club head with improved physical attributes.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their shots, particularly their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits. As a wood-type club head becomes larger, its center of gravity will be moved back away from the face and further toward the toe, resulting in hits flying higher and further to the right than expected (for right-handed golfers). Reducing the lofts of the larger head clubs can compensate for this. Because the center of gravity is moved further away from hosel axis, the larger heads can also cause these clubs to remain open on contact, thereby inducing a "slice" effect (in the case of a right-handed golfer the ball deviates to the right). Offsetting the head and/or incorporating a hook face angle can help compensate for this by "squaring" the face at impact, but often more is required to eliminate the "slice" tendency.

Another technological breakthrough in recent years to provide the average golfer with more distance is to make larger head clubs while keeping the weight constant or even lighter by casting consistently thinner shell thicknesses and using lighter materials such as titanium, magnesium, and composites. Also, the faces of the clubs have been steadily becoming extremely thin, because a thinner face will maximize what is known as the Coefficient of Restitution (COR). The more a face rebounds upon impact, the more energy is imparted to the ball, thereby increasing the resulting shot distance.

Known methods to enhance the weight distribution of wood-type club heads to help reduce the club from being open upon contact with the ball usually include the addition of weights to the body casting itself or strategically adding a weight element at some point in the club. Many efforts have been made to incorporate weight elements into the wood-type club head. These weight elements are usually placed at specific locations, which will have a positive influence on the flight of the ball or to overcome a particular golfer's shortcomings. As previously stated, a major problem area of the higher handicap golfer is the tendency to "slice," which in addition to deviating the ball to the right also imparts a greater spin to the ball, further reducing the overall shot distance. To reduce this tendency, the present patent teaches the placement of weight elements directly into the club head. The placement of weight elements is designed so that the spin of the ball will be reduced, and also a "draw" (a right-to-left ball flight for a right-handed golfer) will be imparted to the ball flight. This ball flight pattern is also designed to help the distance-challenged golfer because a ball with a lower spin rate will generally roll a greater distance after initially contacting the ground than would a ball with a greater spin rate.

SUMMARY OF THE INVENTION

The present invention relates to a large wood-type golf club head with improved playing characteristics. The club head may be formed of a plurality of body members that define an interior volume. A first body member is made of a metallic material and includes a sole portion and a face portion. A second body portion is made of a light-weight material, such as plastic, composite, or a very thin sheet of low density metallic material. The second body portion makes up at least a portion of the club head skirt, and includes one or more concave indentations that extends into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

The club head may include secondary weights positioned extremely low and back from the striking face. A center point on the sole plate defines the lowest point on the club head, and in one embodiment the center point is located directly below the club head center of gravity when the club head is at a 59° lie angle. The center of gravity of the secondary weights are positioned a predetermined distance from the center point. Preferably, each secondary weight center of gravity is at least 0.5 inch rearward of the center point, at least 0.75 inch from the center point toward the heel for the heel weight or at least 0.75 inch from the center point toward the toe for the toe weight, and a maximum 0.25 inch above the center point, whereby the positions of the secondary weights alter the traditional look of the golf club head by bulging outward of the natural contour of the club head.

The secondary weights may be located by reference to a point at which the hosel centerline intersects the sole plate. This distance is then measured from the back surface of the striking face at the midpoint thereof to determine an intersection point. Preferably, the secondary weights are each at least 1.50 inches rearward of the intersection point, at least 0.75 inch toward either the heel or the toe, and a maximum of 0.25 inch above the center point with the club head at a 59° lie angle.

The club head may include an inventive combination of geometric and physical features. For example, the club head may have a large striking surface area, a large face length, and/or a large face height. Increasing the size of the striking face increases the sweet spot, making the golf club more forgiving and, therefore, more playable.

The club head may have a large depth, measured in a face-to-rear direction. Increasing the club head depth moves the center of gravity rearward, which also makes the club head more playable. This aspect of the invention may be quantified in a variety of manners, such as crown surface area. Preferably, the golf club head has a large crown surface area. To further enhance these beneficial attributes, the crown may be sloped from the striking face rearward, with at least a portion of the crown being below the club head center of gravity. Preferably, a substantial portion of the crown periphery is located below (on a sole side) the club head center of gravity.

The club head may be formed in a variety of manners. One such manner is by comolding, a manufacturing process in which two dissimilar materials are joined directly together by molding one of the materials to the other. For example, a metallic portion of the club head can form at least part of a mold used to form a second portion of the club head from a lightweight material such as plastic or a composite material. Other mold pieces may also be used in conjunction with the metallic portion of the club head. Co-molding eliminates the need for welding or adhesives. The club head designer is free to use the mass that would have been taken up by these known attachment means in other, more beneficial ways without increasing the overall mass of the club head. Such beneficial uses of the "freed-up" mass include increasing the overall size of the club head, expanding the size of the club head sweet spot, repositioning the club head center of gravity, and/or producing a greater moment of inertia.

BRIEF DESCRIPTION OF THE DRAWINGS

The present invention is described with reference to the accompanying drawings, in which like reference characters reference like elements, and wherein.

DETAILED DESCRIPTION OF THE PREFERRED EMBODIMENT

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
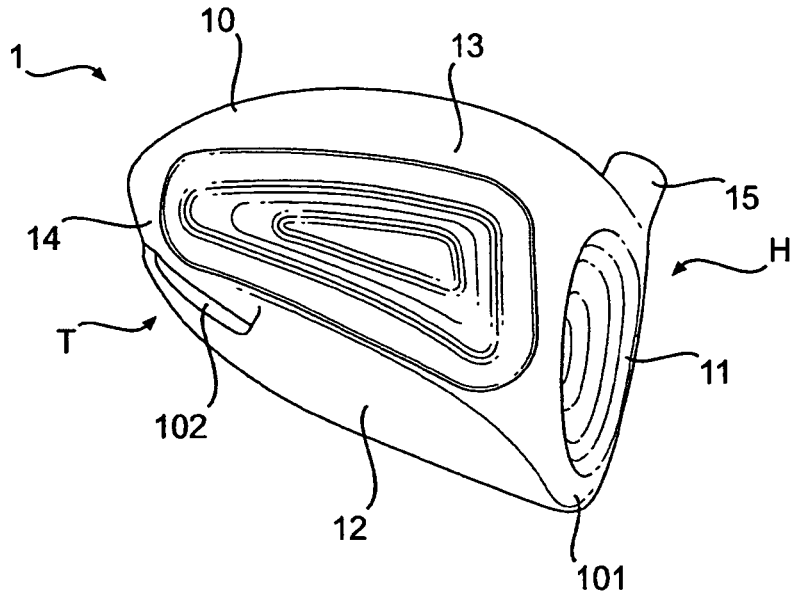
FIG. 1 shows a golf club head of the present invention.

FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 may be provided with grooves or score lines therein of varying design. The club head 1 has a toe T and a heel H.

Figure 2:
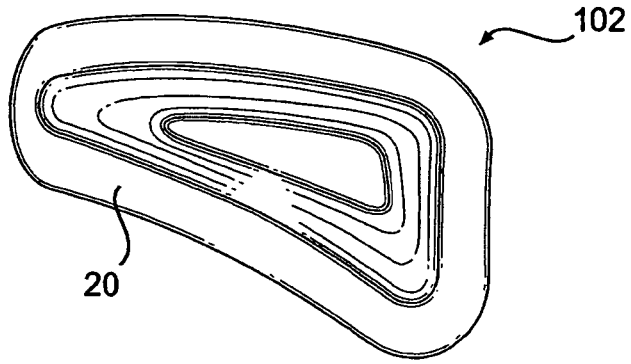
FIG. 2 shows a body member of the golf club head of FIG. 1.

In this illustrated embodiment of FIG. 1, the club head 1 is comprised of a plurality of body members that cooperatively define the interior volume 16. A first body member 101 includes a sole portion and a face portion. The first body member 101 may include a complete face 11 and sole 12. Alternatively, either or both the face 11 and the sole 12 can be inserts coupled to the first body member 101. The club head 1 also includes at least one second body member 102 coupled to the first body member 101 along the skirt 14 in known fashion. The crown 13 can be unitarily a portion of either body member 101, 102 or it may be an insert coupled to either of the body members 101, 102. The second body member 102 includes a concave portion 20 that, when the body members 101, 102 are coupled together, extends inward into the interior volume 16. FIG. 2 shows an isolated view of an exemplary second body member 102.

The first body member 101 preferably is formed of a metallic material such as stainless steel, aluminum, or titanium. The material of the first body member 101 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 1, such as the skirt 14, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 1. These portions of the club head 1 can also be made thinner, enhancing the weight savings. Exemplary uses for this redistributed weight include increasing the overall size of the club head 1, expanding the size of the club head "sweet spot," which is a term that refers to the area of the face 11 that results in a desirable golf shot upon striking a golf ball, repositioning the club head 1 center of gravity, and/or producing a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 1, such as the heel H, the toe T, or the sole 12, maximizes the opportunity to enlarge the sweet spot or produce a greater MOI, making the golf club hotter and more forgiving.

The second body member 102 is light-weight, which gives the opportunity to displace the club head center of gravity downward and to free weight for more beneficial placement elsewhere without increasing the overall weight of the club head 1. When the wall thickness of the second body member 102 is at the minimum range of the preferred thickness, a reinforcing body layer can be added in the critical areas in case the member shows deformations. These benefits can be further enhanced by making the second body member 102 thin. To ensure that the structural integrity of the club head 1 is maintained, these thin panels may preferably include a concave portion 20. Inclusion of these concave portions 20 allow the second body member 102 to withstand greater stress—both longitudinally and transversely—without sustaining permanent deformation or affecting the original cosmetic condition, ensuring the structural integrity of the club head 1 is maintained. Preferred thicknesses for the first body member 101 include from 0.03 inch to 0.05 inch, while preferred thicknesses for the second body member 102 include from 0.015 inch to 0.025 inch. Preferably, the concave portion 20 displaces at least 10 cubic centimeters. More preferably, the concave portion 20 displaces at least 25 cubic centimeters. While the club head 1 can be virtually any size, preferably it is a legal club head. A plurality of concave portions 20 may be used with the club head 1. For example, concave portions 20 of uniform or varying size may be positioned in the toe, heel, back, etc.

Figure 3:
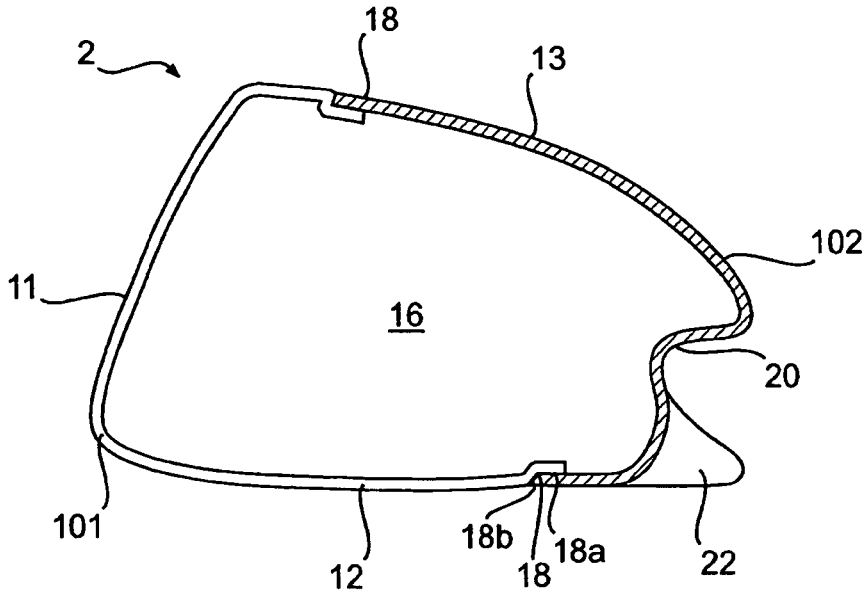
FIG. 3 shows a second club head of the present invention.
Figure 4:
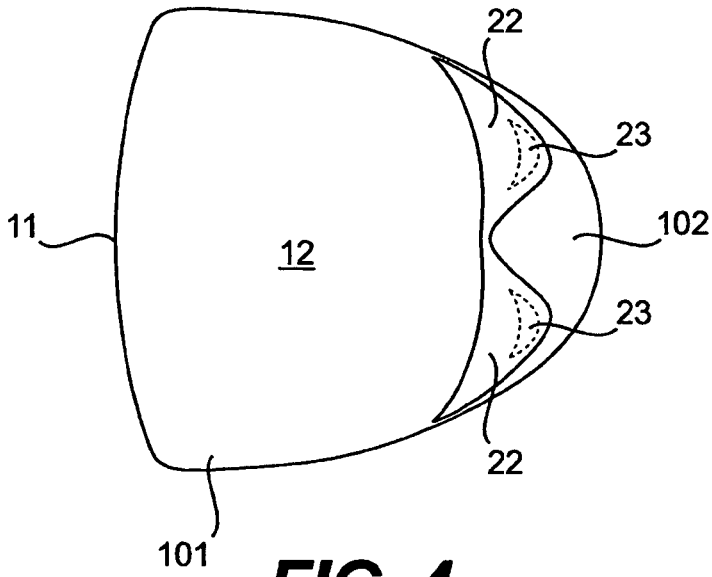
FIG. 4 shows a bottom view of the club head of FIG. 3.
Figure 5:
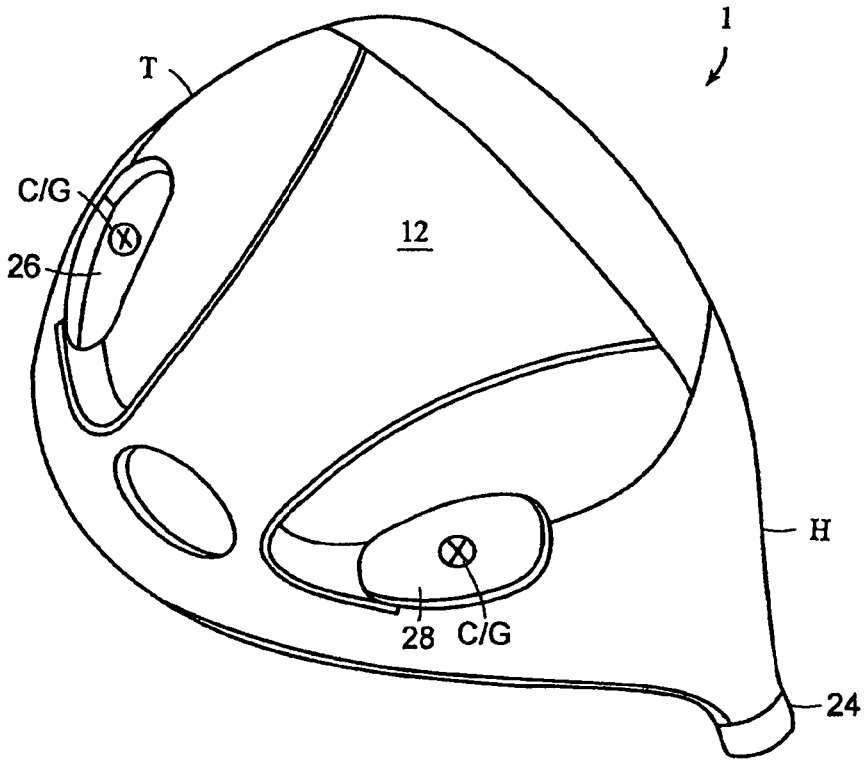
FIG. 5 shows a bottom perspective view of a club head of the present invention.
Figure 6:
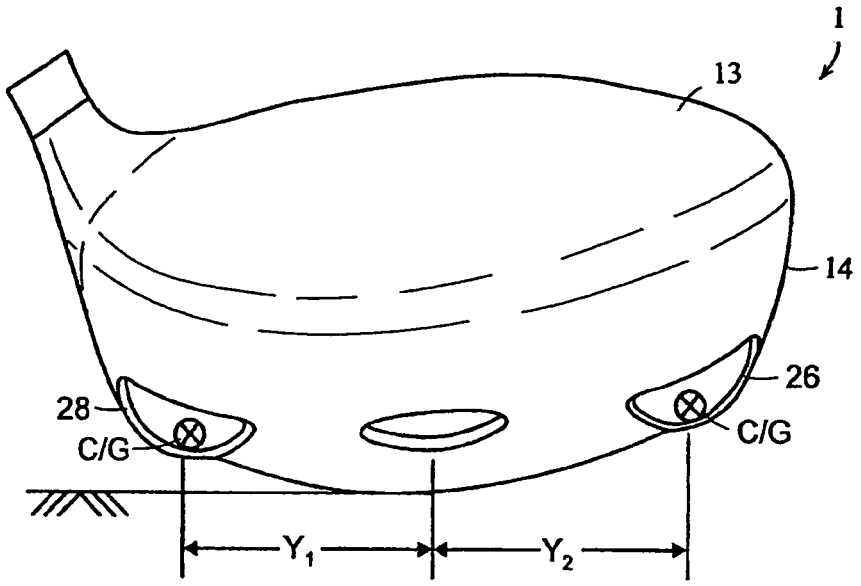
FIG. 6 shows a rear elevation view of the club head of FIG. 5.
Figure 7:
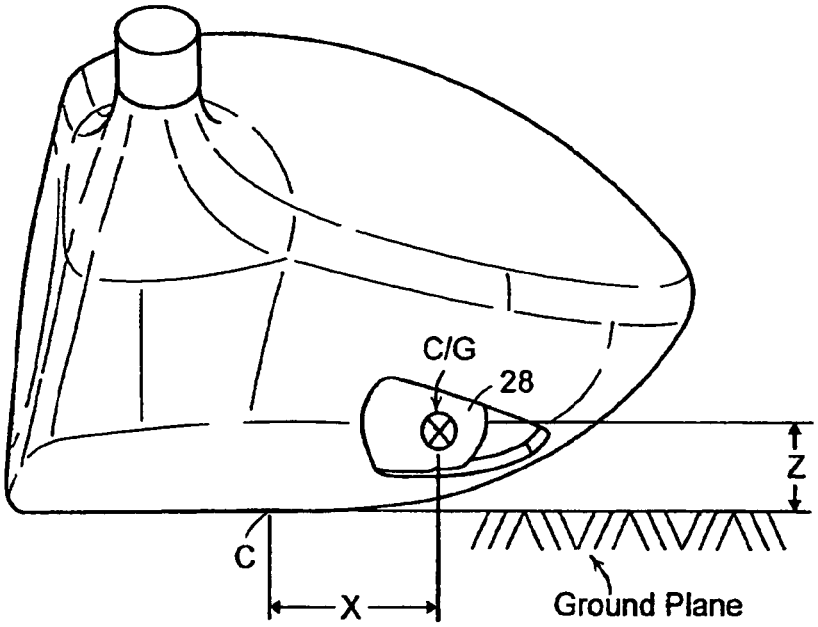
FIG. 7 shows a heel elevation view of the club head of FIG. 5.

FIG. 3 shows a cross-sectional view taken substantially perpendicular to the face 11 of a second club head 2 of the present invention, and FIG. 4 shows a bottom view of the club head 2. In the illustration of this embodiment, the concave portion 20 is positioned at the back of the club head 2. The concave portion 20 preferably is not visible to the golfer at address. In addition to the concave portion 20, the second body member 102 further includes a convex bulge 22 that extends generally away from the interior volume 16. An insert 23 may be positioned within the convex bulge. The insert 23 is not visible from outside the club head 2, and is thus illustrated using broken lines. In a preferred embodiment, the insert 23 is a weight insert. The convex nature of the bulge 23 allows the weight to be positioned to maximize the mechanical advantage it lends to the club head 2. As shown in FIG. 4, the club head 2 may include a plurality of convex bulges 22, such as on a heel side and on a toe side of the club head 2. The club designer may place inserts 23 as desired within the bulges 22. The masses of the inserts may be substantially equal. Alternatively, one of the inserts may have a greater mass than the other. This may be beneficial to design the club to correct a hook swing or a slice swing. A preferred mass range for the weight insert 23 is from 1 gram to 50 grams.

As shown in FIG. 3, the first body member 101 may comprise a majority of the sole 12 and the second body member 102 may include a majority of the crown 13. This beneficially removes a large majority of the mass from the upper part of the club head 2. In this embodiment the first body member 101 includes an attachment perimeter 18 that extends around its edge. The second body member 102 is coupled to the first body member 101 along the attachment perimeter 18. The first and second body members 101, 102 cooperatively define the interior volume 16. The attachment perimeter 18 preferably may contain a step defining two attachment surfaces 18*a*, 18*b*. As illustrated, the second body member 102 may be coupled to both of these surfaces 18*a*, 18*b* to help ensure a strong bond between the body members 101, 102.

While the body members 101, 102 may be formed in a variety of manners, a preferred manner includes forming a complete club head shell (first body member 101) in known manner and removing material to create openings to which the second body member 102 can be coupled. The opening may be created in any desired manner, such as with a laser. The second body member 102 may be joined to the first body member 101 in a variety of manners, such as through bonding or through a snap-fit in conjunction with bonding. If a composite material is used for the concave inserts, molding six plies of 0/90/45/-45/90/0 is preferred.

FIGS. 5-9 illustrate additional aspects of the present invention. In the embodiment illustrated in these figures, the club head 1 includes a crown portion 13, a sole 12, a heel portion H, a toe portion T, a skirt portion 14 connecting the heel portion H to the toe portion T, a front face 11 and a hosel 24 that extends from the heel portion H. The club head 1 can be formed from sheets joined together, such as by welding, or cast, preferably from a titanium alloy. The crown portion 13 can be made from such materials as carbon fiber composite, polypropylene, Kevlar, magnesium, or a thermoplastic. Hosel 24 includes a bore defining a centerline axis C/L.

Figure 8:
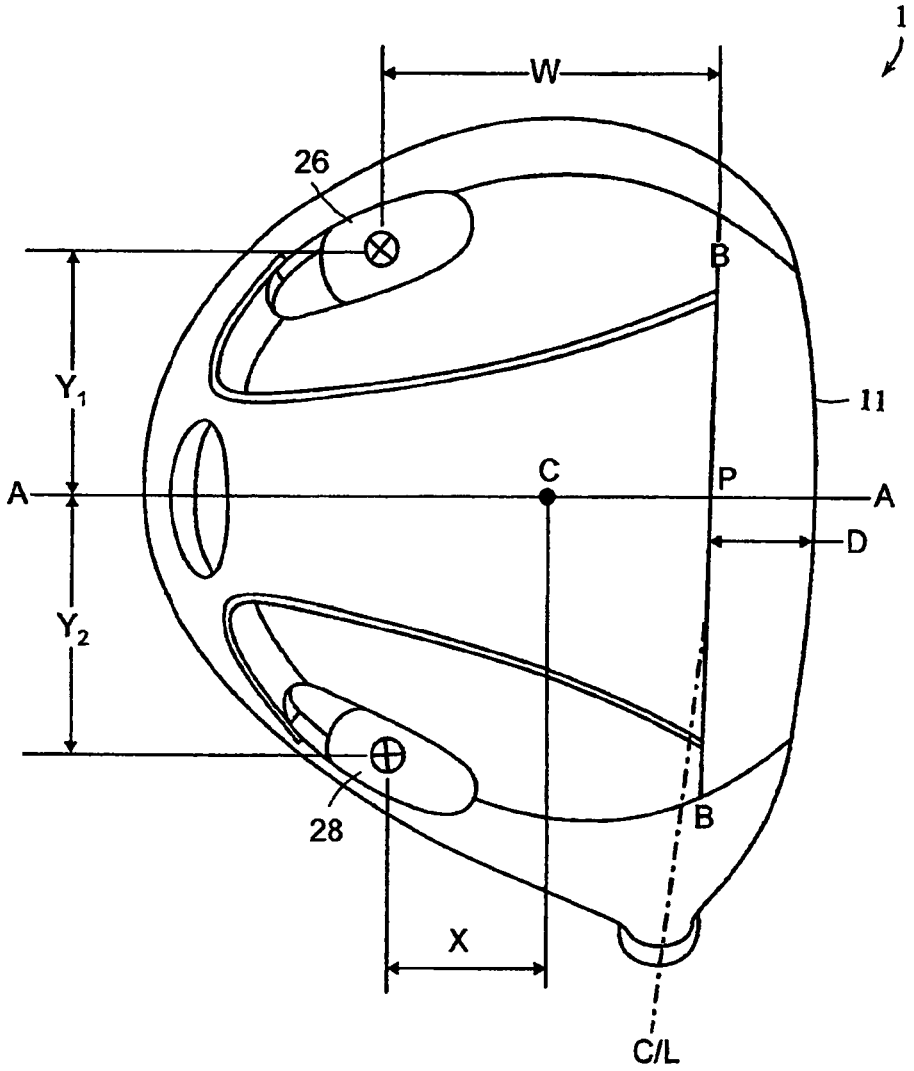
FIG. 8 shows a bottom schematic view of the club head of FIG. 5.
Figure 9:
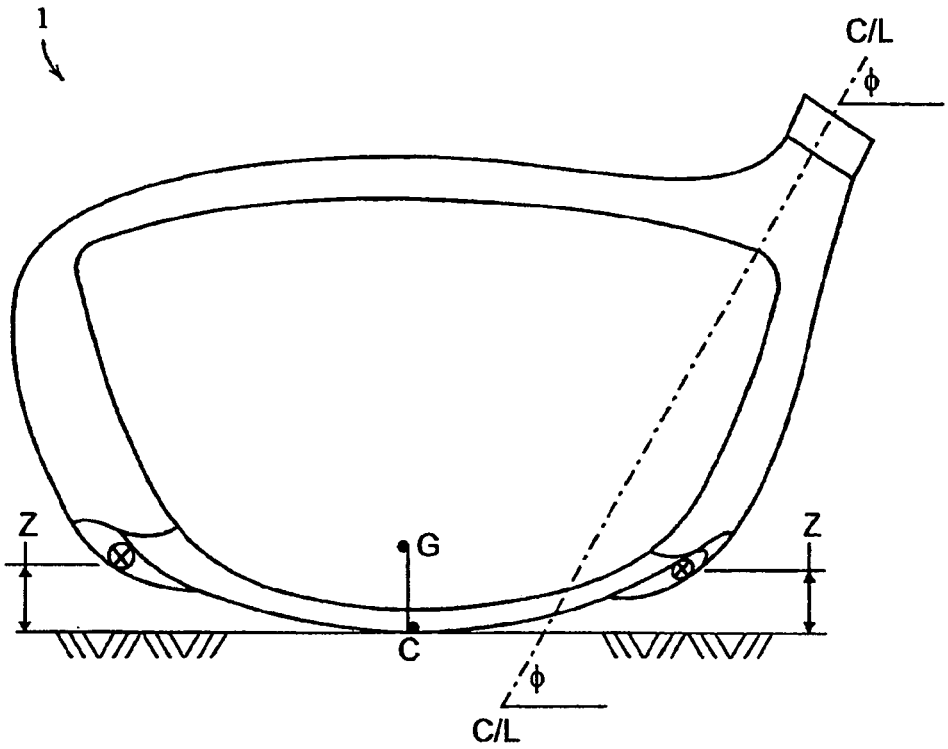
FIG. 9 shows a front cross-sectional view of the club head of FIG. 5.

As best depicted in FIG. 9, the club head 1 of the present invention has a center of gravity G located at an extremely rearward and low position. The location of the center of gravity G is biased by the location of two secondary weights, a toe secondary weight 26 and a heel secondary weight 28, which are both partially outside the traditional look of a golf club head. As shown in FIGS. 5-9, the locations of the two secondary weight elements 26, 28 are established by the relationship of their distances from established points of contact. When the club head is at a lie angle $\phi$ of 59°, the lowest contact point of the sole 12 is at a center point C directly beneath the center of gravity G.

One method of establishing the locations of the secondary weights 26, 28 is discussed herein. As shown in FIG. 8, the center line C/L of hosel 24 intersects the sole plate 12 at a distance D from the rear surface of the front face 11. When extending a line B-B that is substantially parallel to the leading edge of the club head (maintaining the distance D), an intersection point P is made with a line A-A that is perpendicular to and extends rearward from the midpoint of the front face 11. The line A-A extends through the middle of the club head 1 and passes directly beneath the club head center of gravity G. This intersection point P may also be defined by the intersection of line A-A and a vertical plane positioned at an intersection of the hosel center line C/L and the sole 12. The center of gravity C/G of each secondary weight 26, 28 is at a distance W of at least 1.50 inches rearward of the intersection point P, a distance Z that is a maximum of 0.25 inch above the lowest point of contact, which is the center point C of the sole plate 12, and each secondary weight is at least 0.75 inch away from line A-A in opposing directions, which is a distance Y1 towards the toe T for the toe secondary weight 26 and a distance Y2 towards the heel H for the heel secondary weight 28.

The locations of the secondary weights 26, 28 may also be determined for the present invention by measuring from the center point C. From center point C, the center of gravity of each secondary weight 26, 28 is a distance X of at least 0.50 inch rearward along line A-A, the distance Z that is a maximum of 0.25 inch above the center point C, and a minimum of 0.75 inch away from line A-A in opposing directions, towards the toe T for the toe secondary weight 26 and towards the heel H for the heel secondary weight 28. Thus, each secondary weight 26, 28 is a minimum of 0.90 inch from the center point C.

The secondary weights 26, 28 can be selected from a plurality of weights designed to make specific adjustments to the club head weight. The secondary weights 26, 28 can be welded into place or attached by a bonding agent. The weights 26, 28 can be formed from typically heavy weight inserts such as steel, nickel, or tungsten. Preferably, the body of the club head 1 is formed from titanium, and the crown portion 13 from a light-weight material such as carbon fiber composite, polypropylene, Kevlar, thermoplastic, magnesium, or some other suitable light-weight material. Preferred volumes of the club head 1 include from 350 cc to 460 cc. The secondary weights 26, 28 preferably range in mass from 2 to 35 grams, with 10 grams to 35 grams being more preferred. It is well known that by varying parameters such as shaft flex points, weights and stiffness, face angles, and club lofts, it is possible to accommodate a wide spectrum of golfers. But the present invention addresses the most important launch consideration, which is to optimize the club head mass properties (center of gravity and moment of inertia) by creating a center of gravity that is low, rearward, and wide of center. The club head 1 of the present invention encompasses areas of the club head that are not typically utilized for weighting because they adversely alter the traditional look of a club head. The design of this club head 1 allows for a portion of the secondary weights 26, 28 to bulge outside the normal contour of the club head.

Figure 10:
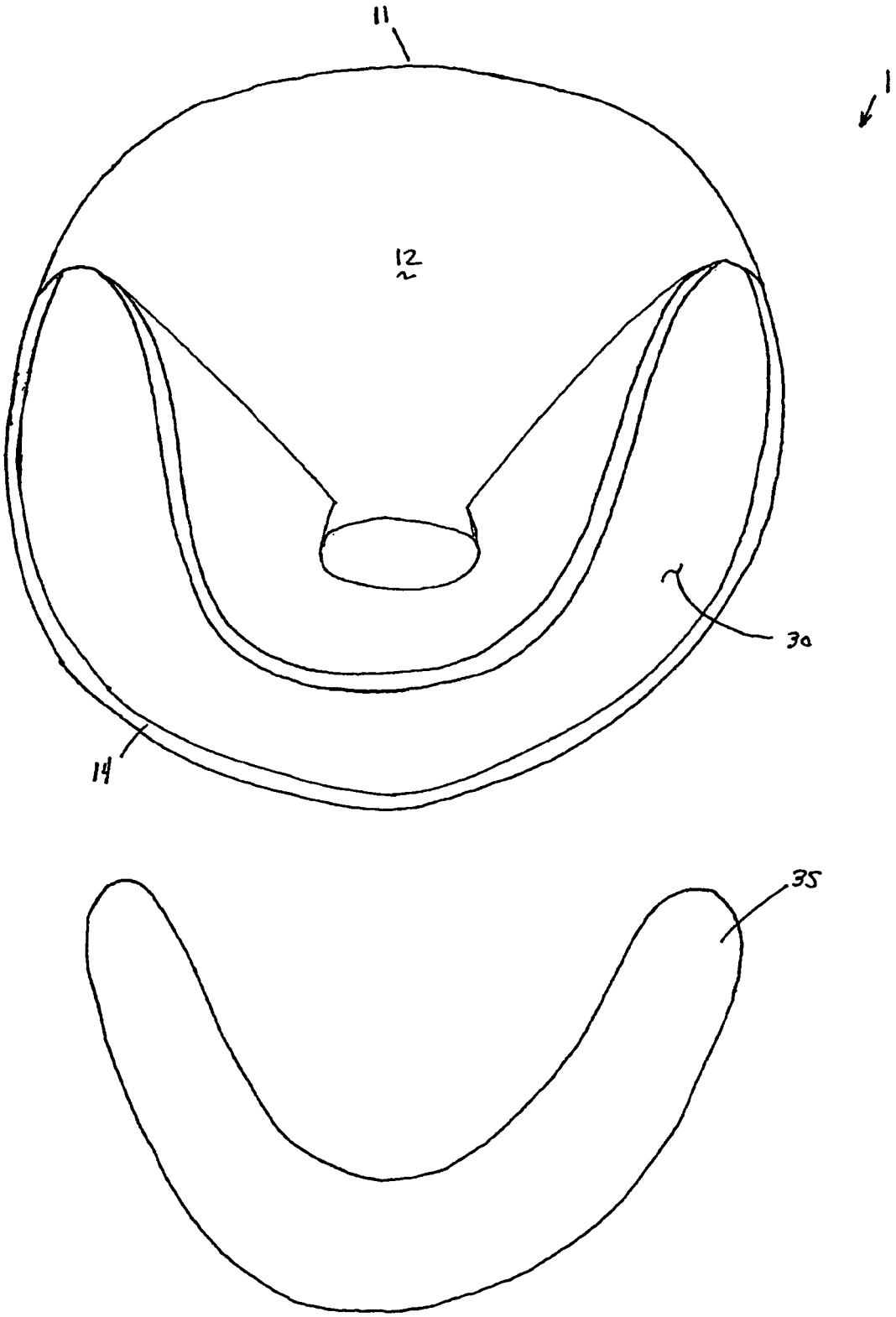
FIG. 10 shows a bottom view of a golf club head of the present invention.

FIG. 10 shows a bottom view of a golf club head 1 of the present invention. The skirt 14 includes an opening 30 towards the rear of the club head 1. An insert 35 is positioned within the opening 30 in known fashion, such as via an attachment perimeter 18, to cooperatively define the interior volume 16. Preferably, the insert 35 is formed of a light-weight material such as a composite material or a polymer material. Using a light-weight insert 35 inherently biases the club head mass toward the sole 12 of the club head 1. It also allows the inclusion of a weight member to achieve a specific moment of inertia and/or center of gravity location while maintaining typical values for the overall club head weight and mass.

Figure 11:
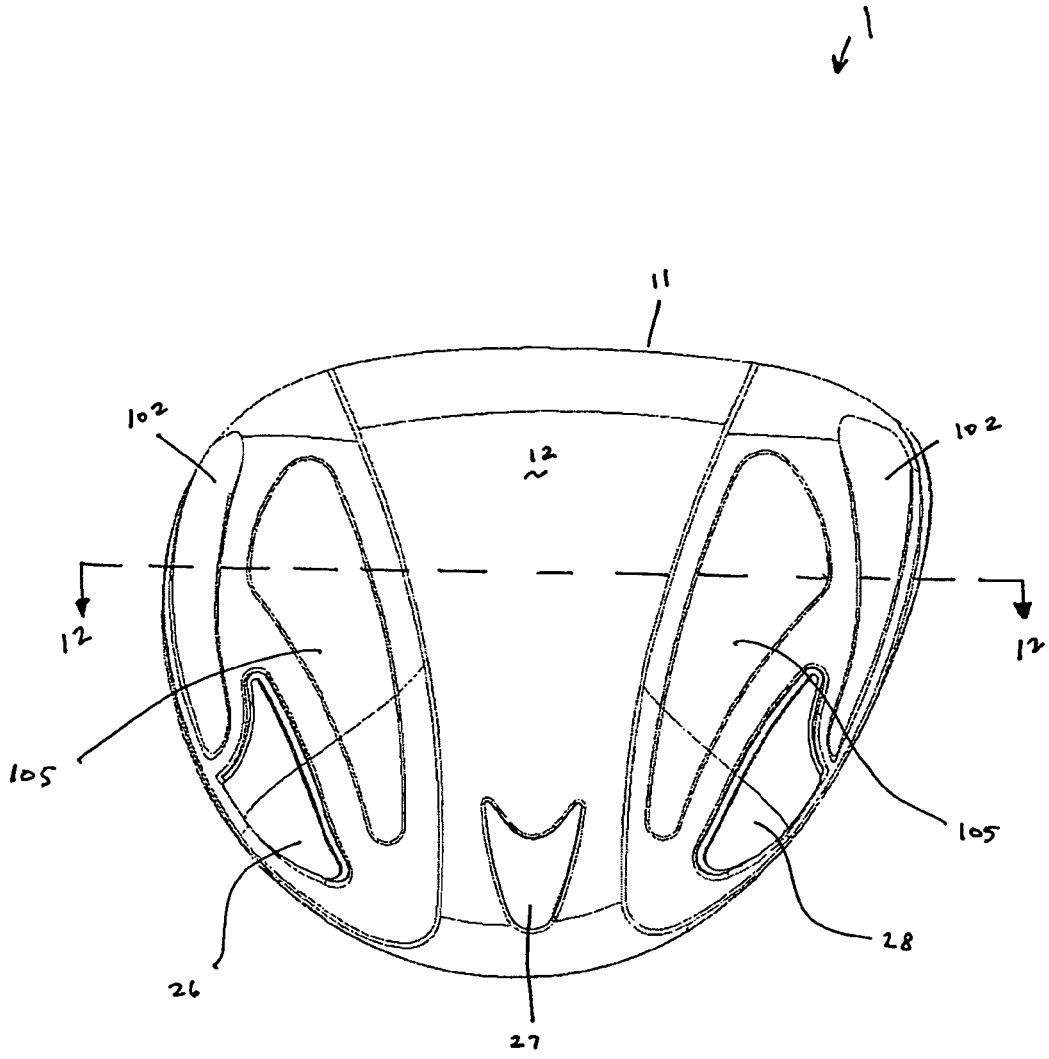
FIG. 11 shows a bottom view of a golf club head of the present invention.

FIG. 11 shows a bottom view of a golf club head 1 of the present invention. In addition to secondary weights 26, 28, the club head 1 includes an insert 27 intermediate the toe secondary weight 26 and the heel secondary weight 28. The insert 27 may be a weight insert similar to the toe and heel secondary weights 26, 28, in which case it also has a preferable mass range of 2 to 35 grams. Alternatively, or in addition to being a weight member, insert 27 may include one or more indicia, such as a model or manufacturer designation. The club head I further includes a sole insert 105; in the illustrated embodiment, two such sole inserts 105 are shown. These inserts 105 preferably are formed of a light-weight material as described above. Such materials likely are robust enough to withstand contact with the ground such as the sole 12 incurs through normal use of the golf club. However, the arcuate shape of the sole 12 in the illustrated embodiment minimizes the likelihood of the inserts 105 contacting the ground. Inclusion of the sole inserts 105 frees even more mass for more beneficial placement in the club head, such as at toe insert 26, intermediate insert 27, and/or heel insert 28. The location of the inserts 105 toward the center of the sole 12 inherently biases the mass toward the outer portions of the club head 1, improving the club head MOI.

Figure 12:
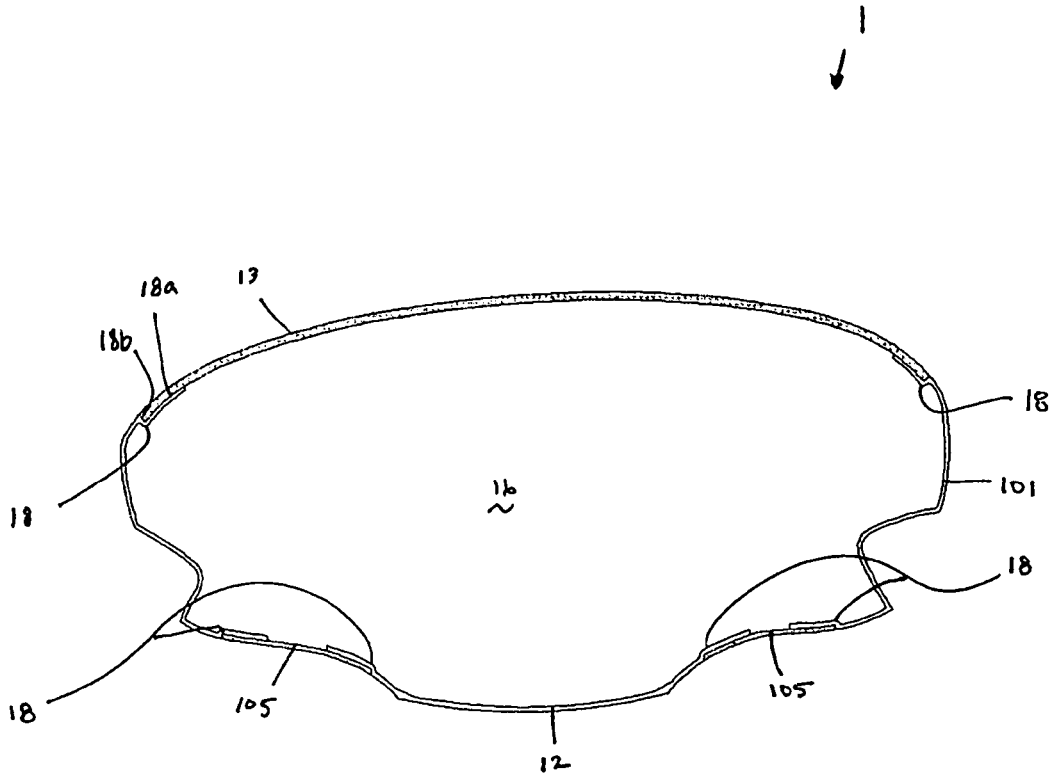
FIG. 12 shows a cross-sectional view of the club head of FIG. 11 taken along line 12-12.

FIG. 12 shows a cross-sectional view of the club head 1 of FIG. 11 taken along line 12-12. Here it is seen that the crown 13 is an insert that is coupled to the metallic first body member 101. The crown insert 13 preferably is formed of a light-weight material, beneficially displacing the club head center of gravity downward and freeing yet more weight for more beneficial placement elsewhere without increasing the overall weight of the club head 1. Due to the inclusion of holes in which to position the crown insert 13, the skirt insert 35, the second body member inserts 102, and the sole inserts 105, the first body member 101 takes on the appearance of a frame. It should be noted that not every insert 13, 35, 102, 105 need be included in a particular embodiment of the present invention, though all may be present. The frame-like nature of first body member 101 is a load bearing structure that ensures that the stresses and strains incurred during a golf swing, including those generated through striking a golf ball or the ground, do not detrimentally affect the light-weight portions of the club head 1, which experience a reduced level of stress and strain. These club head portions, which may include secondary body member 102, crown 13, skirt insert 35, and sole inserts 105, advantageously can be formed of a lighter, weight-efficient secondary material such as low density metal alloys, plastics, composites, and the like, which have a lower density or equivalent density than the previously mentioned metallic materials, beneficially allowing the club head designer to redistribute the "saved" weight or mass to other, more beneficial locations of the club head 1. These portions of the club head 1 can also be made thinner, enhancing the weight savings.

The first body member 101 preferably includes an attachment perimeter 18 for each insert (including the crown 13). These attachment perimeters 18 extend around the edge of the respective openings. Preferably, each attachment perimeter 18 includes a step defining two attachment surfaces 18*a*, 18*b*, which provide additional assurance of a strong bond between the respective club head components. (While each attachment perimeter 18 of FIG. 12 includes a step defining two attachment surfaces 18*a*, 18*b*, such attachment surfaces 18*a*, 18*b* are called-out in only one location for the sake of clarity.)

The openings in the club head 1 into which the inserts 13, 35, 102, 105 are positioned preferably may be created by forming a complete club head shell in known fashion, and then creating the openings therein. One preferred method of creating the openings is by using a laser to remove portions of the metallic material of the first body member 101. This method provides for tight tolerances. The attachment perimeter 18, including attachment surfaces 18*a*, 18*b*, may be formed in a variety of manners, such as machining the first body member 101 after laser cutting the opening in the club head 1.

Alternatively to using adhesives and attachment surfaces 18*a*, 18*b*, the light-weight inserts 13, 35, 102, 105 may be coupled to the club head 1 by co-molding. The process of comolding allows the insert(s) to be retained in place and coupled to the club head 1 without the need for attachment surfaces and adhesives, welding, etc. Exclusion of these traditional joining materials and structures frees more mass to be positioned in more beneficial locations in the club head 1. The club head designer is free to position the mass that would have been consumed by the attachment surfaces and the attachment media (adhesive, epoxy, weld bead, mechanical fastener, etc.) as desired to, for example, beneficially position the club head center of gravity, achieve a desired center of gravity location, achieve desired moment of inertia properties, increase the club head size, increase the club head sweet spot, etc., without increasing the overall weight of the club head.

This co-molding process may be performed in a variety of manners. In one such manner, an initial club head body is formed in known fashion. The initial club head body preferably includes one or more cavities or recesses. See, for example, opening 30 in FIG. 10. Thereafter, the initial club head body is placed within a mold. Liquid material is then inserted into the mold, filling or at least contacting the opening 30. Of course, the interior of the mold is shaped to impart the desired shape to the finished club head. The initial club head and molding material is retained within the mold for the necessary amount of time and subjected to the requisite thermal cycle(s), if appropriate for the materials used. In this manner, the light-weight molding material is affixed directly to the metallic (or other) material of the club head body. The club head, with the insert 35 intact, is then removed from the mold. Alternatively, plies of composite material, or other light-weight material, can be used instead of a liquid molding material. The molding times and temperatures will vary depending on the material(s) used, the thickness of the part(s) being formed, and other factors known to the skilled artisan. The mold may include other parts, such as an inflatable bladder, as desired by the club head designer. After the molding process is complete, or prior to the absolute completion of the molding process, as desired, the bladder is deflated and removed through a small hole in the club head body, which hole is later filled in or covered. The mold may also or alternatively be formed in part by mold pieces that are later removed from the club head interior, such as through an opening in the face that is later covered by an insert. It should be noted that the molded material need not contact the other ("major") portion of the club head along the entire opening. Rather, the major body-minor body contact need be only so much as is necessary to maintain mechanical and structural integrity of the resulting golf club. This limited contact area may be achieved, for example, through use of an inflatable bladder. Aspects of the invention discussed above, such as weights 23, 26, 28, can also be used with the co-molded sole 12.

In addition to reducing that amount and number of materials needed, co-molding also beneficially allows the use of materials not traditionally used by golf club head designers. For example, a translucent, plastic material may be used as the light-weight insert material. The thickness of the molded material can also be reduced. For example, the thickness of the comolded insert may be from 1 to 1.2 mm. The molded insert may have a varying thickness, such as by providing a smooth inner surface and a contoured outer surface or vice versa. If a translucent material is used, the coloring and/or shading can be varied by varying the thickness of the insert.

Each sole insert 105 preferably has a mass of 0.5 gram to 10 grams, and more preferably from 1 gram to 5 grams. The sole inserts 305, as well as the other inserts, may be beveled or stepped slightly to provide a location for any excess adhesive. In one embodiment, the toe and heel sole inserts 26, 28 each have a preferred mass range of 4 grams to 7 grams, while the intermediate insert sole 27 has a preferred mass range of 2 grams to 3 grams. In one embodiment, the thickness of the club head components is tapered such that the walls are thicker towards the face 11 and thinner towards the rear of the club head 1. Such wall thickness tapering frees more mass for more beneficial placement in the club head 1.

Figure 13:
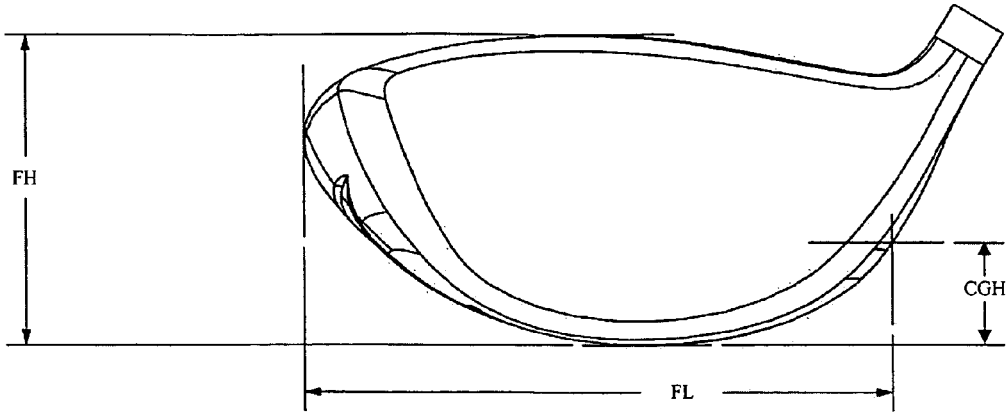
FIG. 13 shows a front view of a golf club head of the present invention.
Figure 14:
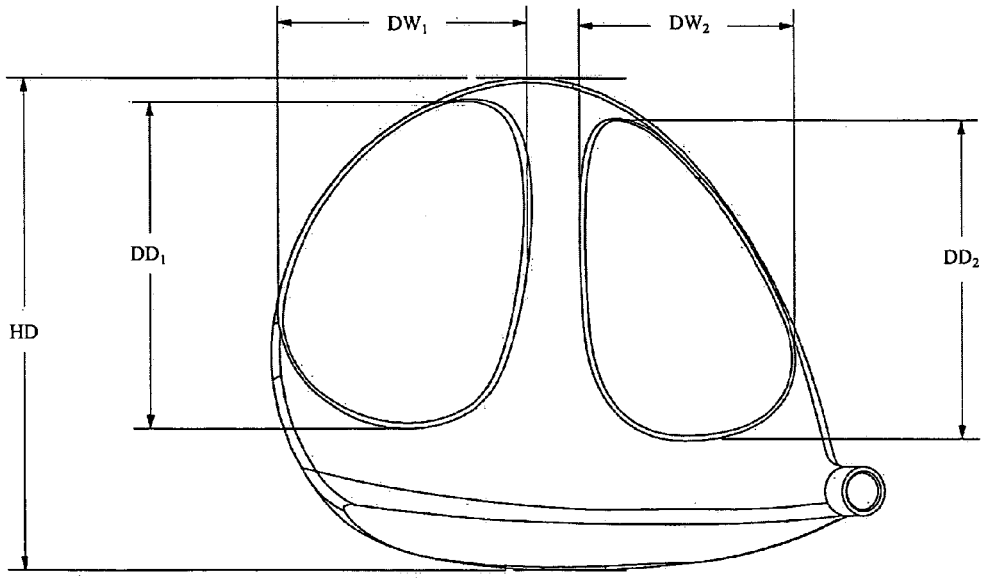
FIG. 14 shows a top view of the golf club head of FIG. 13.

In another aspect of the present invention, the face 11 is made to be relatively large. Providing a large face 11 increases the playability and forgiveness of the club head by, for example, increasing the size of the club head sweet spot and allowing for beneficial placement of weight members further away from the club head centerline. The governing bodies of the rules of golf have deemed the maximum distance from the heel to the toe of the club head to be 5 inches, and further that the maximum distance from the sole to the crown of the club head to be 2.8 inches. Thus, in a preferred embodiment illustrated in FIGS. 13 and 14, the face has a length FL (i.e., a measurement in the heel-toe direction along the widest part of the face 11) of 5 inches and a height FH (i.e., a measurement in the sole-crown direction along the tallest part of the face 11) of 2.8 inches. These dimensions may be slightly less to ensure compliance with the rules. For example, the face length FL may be from 4.5 to 5 inches, more preferably from 4.8 to 5 inches, and the face height FH may be from 2.5 to 2.8 inches, more preferably from 2.65 to 2.8 inches. The dimensions of the face 11 may also be expressed as an aspect ratio, which is the ratio of the face length FL to the face height FH. The aspect ratio for the face 11 preferably is from 1.5 to 2, more preferably from 1.7 to 1.9. The face dimensions may also be expressed as a measurement of the face surface area. Preferably, the face surface area is greater than 40 $cm^2$, more preferably greater than 45 $cm^2$, and still more preferably greater than 50 $cm^2$. A preferred range for the face surface area is from 40 $cm^2$ to 60 $cm^2$. In one preferred embodiment, the face surface area is approximately 54 $cm^2$.

In addition to having a big face 11 (i.e., wide in the heel-toe dimension (FL) and tall in the sole-crown dimension (FH)), the club head 1 may also be long in the face-rear dimension. Providing a long club head body 10 moves the club head center of gravity rearward from the face, further increasing the playability of the resulting golf club. This also allows for beneficial placement of weights far behind the face 11, and, in one embodiment, away from the club head centerline. The governing bodies of the rules of golf have deemed that the distance from the heel to the toe of the club head must be greater than the distance from the face to the back. Thus, in a preferred embodiment, the club head depth HD is just less than the club face width. Preferred dimensions for the club head depth HD may be from 4.5 to 5 inches, more preferably from 4.8 to 5 inches. Preferably, the club head depth HD is within 0.25 inch of the club head face length FL.

Preferably, the club head dimensions are measured on horizontal lines between vertical projections of the outermost points of:

the heel and the toe (dimension FL); and the face and the back (dimension HD); and on vertical lines between the horizontal projections of the outermost points of the sole and the crown (dimension FH).

COR is an important characteristic of golf clubs, especially wood-type golf clubs such as club head 1. COR is a measure of the efficiency of the transfer of energy between two colliding bodies, in this case the golf club and the golf ball. As the efficiency of the energy transfer increases, the COR, the initial ball velocity, and the ball travel distance increase. During a golf shot, the club face and the golf ball deform upon impact. The club face can deform and then recover more than the ball can. The ultimate aim of the dynamics or physics of the collision is to limit the amount of deformation the ball sustains because more energy is lost from a perfect collision due to heat, etc. in the ball. By allowing the strike face 11 to deform or deflect as much as possible over a greater percentage of the face 11, a higher performance strike face 11 can be constructed. As the amount of club face deformation increases, so do the club head COR and the forces applied to the ball. The inventive large club head 1 preferably contains a large COR, for example 0.8 or greater, and more preferably 0.82 or greater. One specific COR value that is preferred is 0.83, the maximum limit allowed by the governing bodies of golf.

Due to the increased width (heel-to-toe) of the club face 11 and the increased length (front-to-back) of the club head 1, the crown 13 has an increased surface area. This crown surface area preferably is greater than 100 $cm^2$ or from approximately 100 $cm^2$ to 150 $cm^2$, and one exemplary crown surface area is approximately 107 $cm^2$. Furthermore, a distance, substantially at the center of the club head 1, from the crown-face intersection to the crown-skirt intersection at the rear of the club head is greater than 4 inches. More preferably, this distance is greater than 4.25 inches, and more preferably greater than 4.5 inches. This distance may be measured as the trace along the crown in a vertical plane perpendicular to the club face 11 and, for example, passing through the geometric center of the club face 11.

As stated above, providing a properly balanced, large club head results in the club being more playable and forgiving. The club head 1 preferably has a volume greater than 400 $cm^3$. More preferably, this club head volume is greater than 425 $cm^3$. Still more preferably, the club head volume is greater than 450 $cm^3$. The governing bodies of the rules of golf have deemed the club head must not exceed 460 $cm^3$, with a tolerance of 10 $cm^3$. Thus, the club head volume should satisfy the limitations imposed by the governing bodies.

Figure 15:
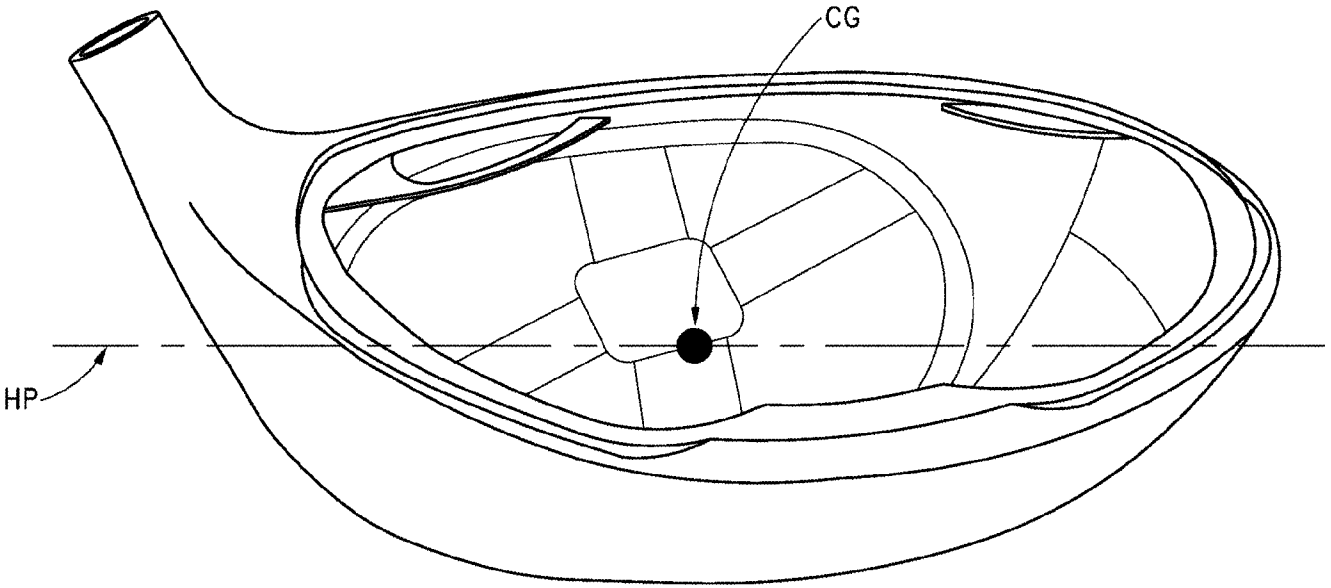
FIG. 15 shows a rear view of a golf club head of the present invention with the crown removed.
Figure 16:
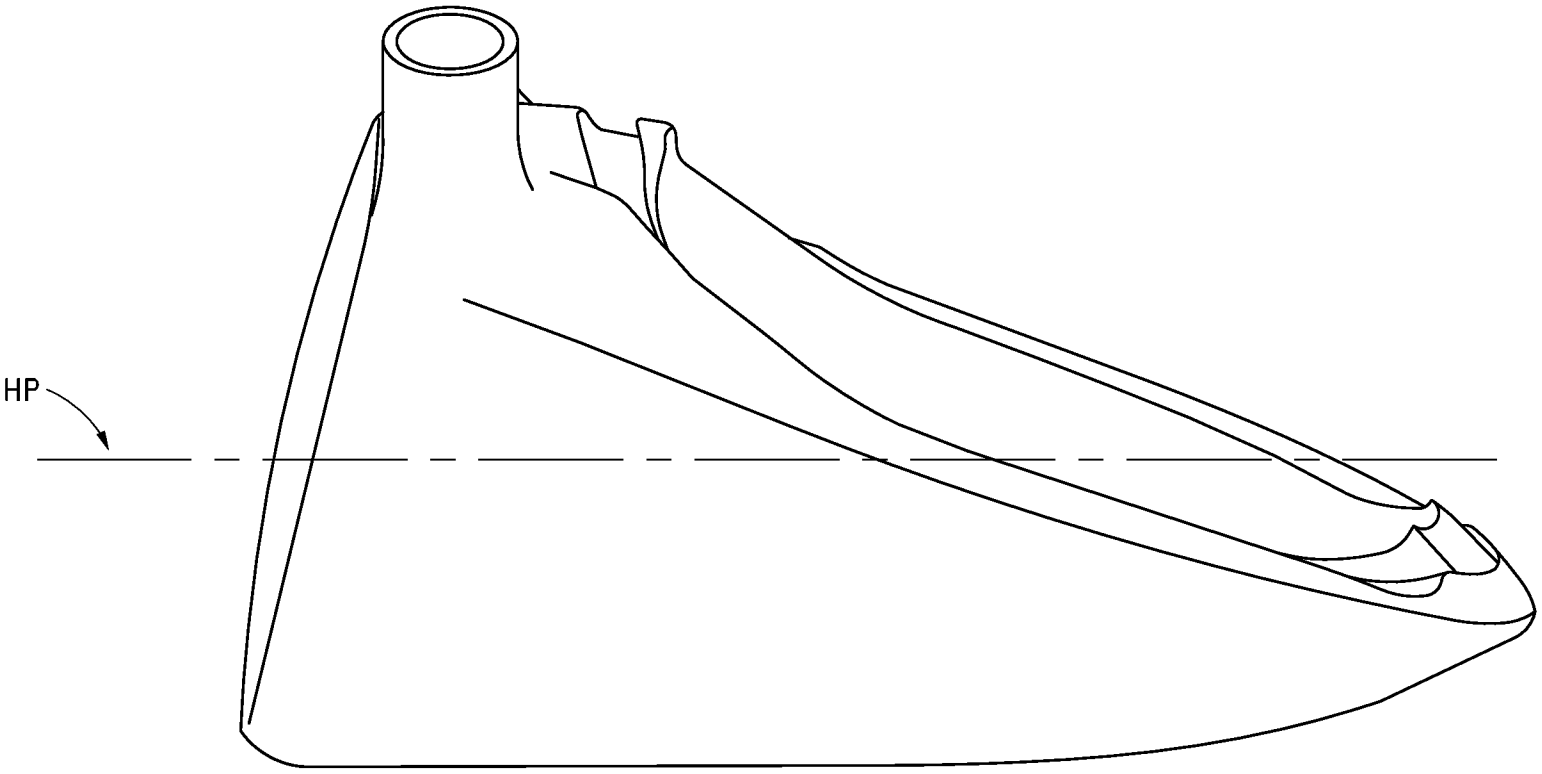
FIG. 16 shows a heel view of the golf club head of FIG. 15.
Figure 17:
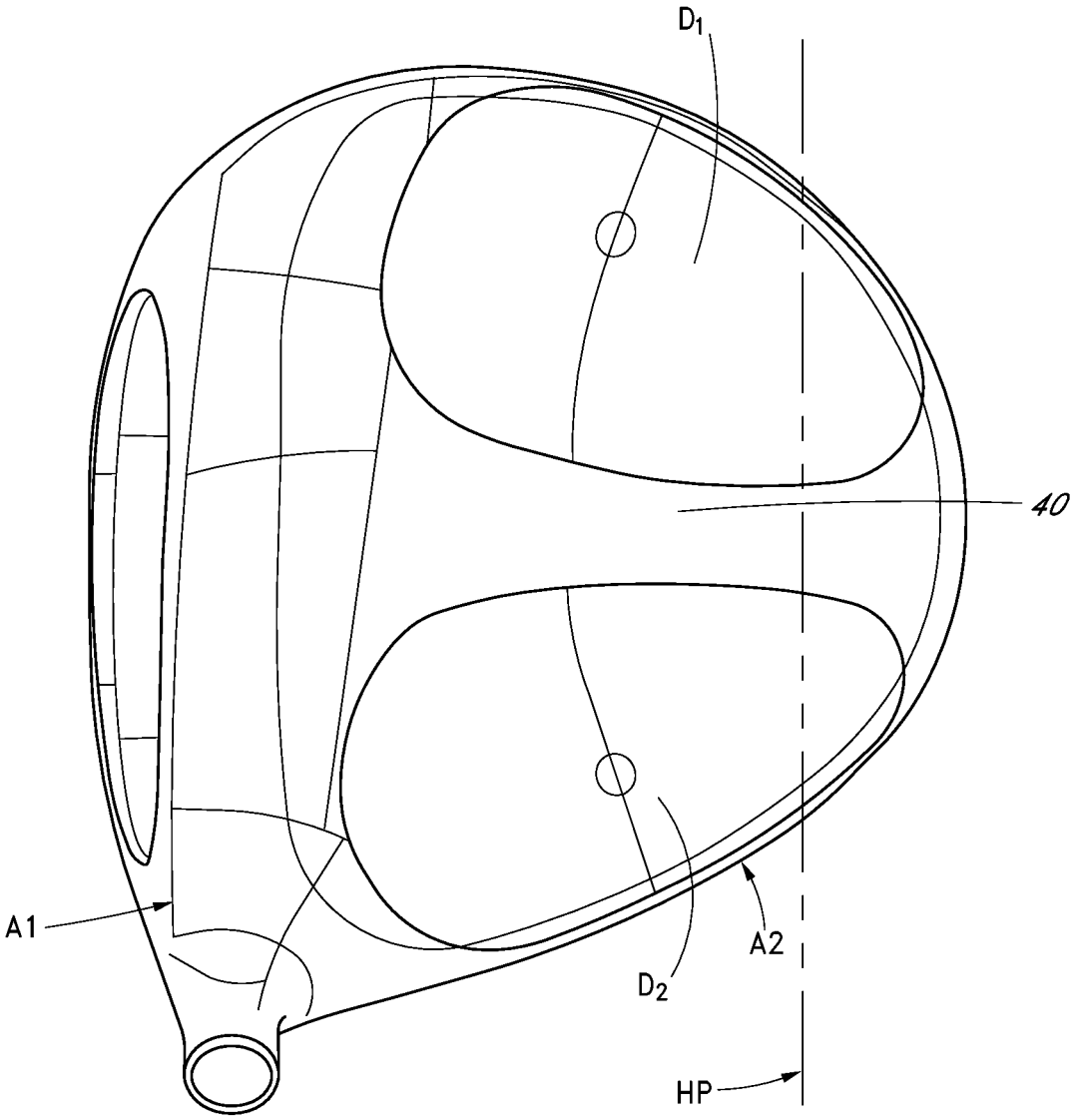
FIG. 17 shows a top view of the golf club head of FIG. 15 with the crown in place.

To position the club head center of gravity toward the sole 12 and to increase the club head MOI, which makes the club head 1 more forgiving and playable, the crown 13 of the club head 1 may have a unique design. According to this aspect of the invention, at least 35% of the club head outer periphery is positioned below the club head center of gravity. As used here, outer periphery is defined as the arc length of the outermost area of the crown 13. This aspect is illustrated in FIGS. 15-17. Turning first to FIG. 15, a rear view of the club head 1 (with the crown 13 removed) is shown. A horizontal plane HP passing through the club head center of gravity CG is shown for reference purposes. As seen in FIG. 16, which shows a heel view of the club head of FIG. 15, the club head body 10 and the crown 13 (not shown) slope downward from the front to the rear portions of the club head 1. FIG. 17 shows a top view of the golf club head of FIG. 15 with the crown 13 in place. Due to the sloped crown profile, a large portion of the crown 13 is below the club head center of gravity CG. The outer periphery of the crown 13 is comprised of two arc lengths, A1 and A2. A1, which is illustrated in a heavy solid line in FIG. 17, indicates that portion of the crown outer periphery that is above the club head center of gravity CG. A2, which is illustrated in a heavy dashed line in FIG. 17, indicates that portion of the crown outer periphery that is below the club head center of gravity CG. In the exemplary embodiment illustrated in FIG. 17, 35% of the crown outer periphery is below the club head center of gravity CG. In another preferred embodiment, 40% of the crown outer periphery is below the club head center of gravity CG. In still another preferred embodiment, 45% of the crown outer periphery is below the club head center of gravity CG. In another preferred embodiment, the rear height of the club head 1 is less than or equal to 25% of the front height of the club head 1.

Figure 18:
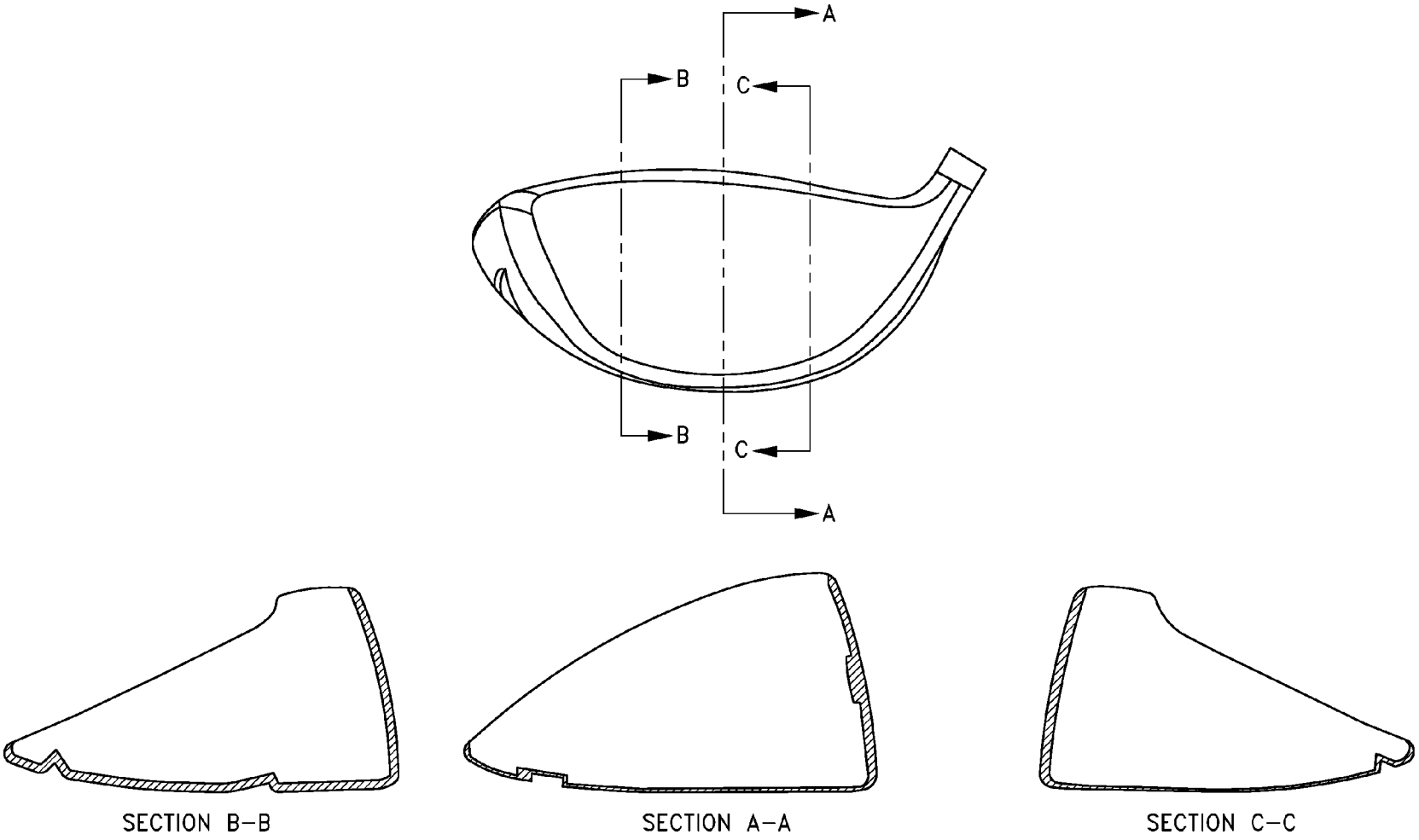
FIG. 18 shows a front view of a golf club head of the present invention and three cross-sectional views therethrough.

A structural or stiffening rib 40 to absorb and transmit stress and strain generated during normal use of the resulting golf club may be provided. One beneficial location for such a rib 40 is along a central portion of the crown, with a curved, convex profile (when viewed from above the club head 1). As the rib 40 manages the brunt of the stress and strain generated during use of the golf club, other portions of the crown 13 may be designed to enhance the playability of the golf club. For example, the crown 13 may contain concave dimples $D_1$, $D_2$. Dimples $D_1$, $D_2$ lower the crown profile, which in turn lowers the club head center of gravity. Preferred dimensions for the dimple $D_1$, which is biased toward the club head toe, are: 2.9 to 3.5 inches for the depth $DD_1$, with 3 to 3.3 being more preferred; 2.2 to 2.6 inches for the width $DW_1$, with 2.3 to 2.5 inches being more preferred. Preferred dimensions for the dimple $D_2$, which is biased toward the club head heel, are: 2.8 to 3.4 inches for the depth $DD_2$, with 3.1 to 3.3 being more preferred; 1.9 to 2.3 inches for the width $DW_2$, with 2 to 2.2 inches being more preferred. Alternatively, the dimples $D_1$, $D_2$ can be identical. However, to achieve a properly balanced club head, in light of factors such as the presence of the hosel 15 and the club head par area, the dimples $D_1$, $D_2$ may be of different size and dimension, as provided above. Preferably, the center of gravity height CGH, as measured from the sole 12, is less than 1 inch. Alternatively, the center of gravity height CGH may be from 0.7 to 1.1 inch, and more preferably 0.8 to 0.9 inch. These concepts are illustrated in FIG. 18, which shows a front view of the golf club head and three cross-sectional views. Section A-A is through a central portion of the club head, section BB is through a toe portion of the club head, and section C-C is through a heel portion of the club head.

To remove yet more weight from the upper portions of the club head, the crown, or portions of the crown, can be provided in a light-weight material, such as discussed with respect to the second body member 102 above. The entire crown 13 may be formed of such light-weight material, or only portions of the crown, such as dimples D\ and/or D2 may be formed of lightweight material. It should be noted that "light-weight material" includes thin portions of metal or other typically heavy material. The curved profile of the crown 13, described above, helps to ensure that the structural integrity of the crown 13 is maintained.

The above-described club head attributes also impart a beneficial MOI to the club head 1. Preferably, the club head 1 has a MOI about a horizontal axis passing through the club head center of gravity of 260 $kg \cdot mm^2$ or greater, and a MOI about a vertical axis passing through the club head center of gravity of 420 $kg \cdot mm^2$ or greater. More preferably these MOI values are 270 $kg \cdot mm^2$ and 450 $kg \cdot mm^2$, respectively. Still more preferably MOI values are 280 $kg \cdot mm^2$ and 470 $kg \cdot mm^2$, respectively. Top range MOI values may be 350 $kg \cdot mm^2$ and 550 $kg \cdot mm^2$, respectively.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIG. 9. The direction references are included to facilitate comprehension of the inventive concepts disclosed herein, and should not be read as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while two body members have been described above, the present invention may be embodied in a club head having more than two body members. Additionally, the present invention may be embodied in any type of club in addition to the wood-type clubs shown in the illustrated embodiments. Thus the present invention should not be limited by the above described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A process of forming a hollow wood-type golf club head, comprising:

providing an initial hollow wood-type club head body, said initial hollow wood-type club head body including a plurality of openings along a sole portion of the club head body;

positioning said initial hollow wood-type club head body within a mold;

inserting a molding material within said mold adjacent said plurality of openings to form a plurality of light weight inserts on the hollow wood-type club head body, the light-weight inserts each having a density less than that of the club head body;

molding said molding material to form the light-weight inserts and produce a finished hollow wood-type body defining a hollow, interior volume wherein the light-weight inserts form a portion of the finished hollow wood-type body corresponding to and filling the openings; and removing the finished hollow wood-type golf club head from said mold.

2. The process of claim 1, comprising molding the light-weight inserts to have a thickness of between 1 to 1.2 mm.

3. The process of claim 1, comprising molding the light-weight inserts out of plastic material.

4. The process of claim 1, comprising molding the light-weight inserts out of translucent material.

5. The process of claim 1, comprising molding the light-weight inserts to have a varying thickness.

6. The process of claim 5, wherein the light-weight inserts are provided with a smooth inner surface and a contoured outer surface.

7. The process of claim 5, wherein the light-weight inserts are provided with a smooth outer surface and a contoured inner surface.

8. The process of claim 1, further comprising varying the coloring and/or shading of the light-weight inserts by varying the thickness of the light-weight inserts.

9. The process of claim 1, comprising molding the light-weight inserts to have a weight between 0.5 gram and 10 grams.

10. The process of claim 8, wherein the light-weight inserts have a mass between 1 gram and 5 grams.

11. The process of claim 1, comprising molding the light-weight inserts to have a beveled or stepped construction.

12. The process of claim 1, wherein no adhesives or welding is used during the process.

13. The process of claim 1, further comprising inserting a bladder into said mold within said initial club head body.

14. The process of claim 1, wherein said providing includes providing an initial club head body further having an opening located in a skirt region of said initial club head.

15. The process of claim 1, wherein said providing includes providing an initial club head body further having an opening located in a crown region of said initial club head.

16. The process of claim 1, wherein said inserting includes inserting a fluid molding material within said mold.

17. The process of claim 5, wherein said inserting further includes mixing a plurality of fluid materials and inserting said mixed fluid into said mold.

18. The process of claim 1, wherein said inserting includes positioning one or more plies of composite material within said mold.

19. The process of claim 1, wherein said providing includes removing material from a precursor club head body to form said initial club head body.

* * * * *